US005317888A

United States Patent [19]

Towns

[11] Patent Number: 5,317,888

[45] Date of Patent: Jun. 7, 1994

[54] CABINET FOR USE BENEATH A BED FRAME

[76] Inventor: Leonard O. Towns, 16926 Butteroak Dr., Spring, Tex. 77379

[21] Appl. No.: 889,069

[22] Filed: May 26, 1992

[51] Int. Cl.[5] ..... E05B 65/52

[52] U.S. Cl. ..... 70/63; 5/308; 5/931; 109/51; 206/317; 224/912; 248/551

[58] Field of Search ..... 70/63; 109/51, 52; 5/503.1, 507.1, 658, 308, 931; 224/912, 913; 248/551, 552, 553; 206/317

[56] References Cited

U.S. PATENT DOCUMENTS

| | | | |
|---|---|---|---|
| 996,811 | 7/1911 | Tarbet | 5/308 |
| 1,088,468 | 2/1914 | Smith et al. | 5/11 X |
| 1,893,186 | 1/1933 | Thomas, Jr. et al. | 312/348.3 X |
| 3,743,335 | 7/1973 | Reilhac et al. | 292/DIG. 72 X |
| 4,715,075 | 12/1987 | Shamie | 5/11 X |
| 4,788,838 | 12/1988 | Cislo | 5/503.1 X |
| 4,863,208 | 9/1989 | Streett | 292/DIG. 72 X |
| 4,869,449 | 9/1989 | Goodman | 5/658 X |
| 4,890,466 | 1/1990 | Cislo | 70/63 |
| 4,971,390 | 11/1990 | McGinley | 5/308 X |
| 5,056,342 | 10/1991 | Prinz | 70/63 |

FOREIGN PATENT DOCUMENTS

| | | | |
|---|---|---|---|
| 845 | of 1901 | United Kingdom | 5/308 |

*Primary Examiner*—Lloyd A. Gall

[57] ABSTRACT

A device for attachment to a bed frame for the receipt of articles therein having a receptacle with a closed end and an open end, a door fastened to said open end, a lock attached to the door so as to fix a position of the door with respect to the receptacle, a clamp attached to a forward end of the receptacle so as to affix the receptacle to the bed frame, and a support connected to a back end of the receptacle so as to support the receptacle above a surface. The clamp is a mounting bracket affixed by a bolt to the receptacle. An area between the receptacle and the mounting bracket engages corresponding surfaces of the bed frame. The receptacle has a top surface, a base, a pair of sides, and a pair of ends extending upwardly relative to the base. The support is an extendible leg fastened to a rear end of the receptacle so as to support the receptacle in a generally level condition.

11 Claims, 8 Drawing Sheets

CABINET FOR USE BENEATH A BED FRAME

TECHNICAL FIELD

The present invention relates generally to safe storage devices for guns. More particularly, the present invention relates to lockable drawers for storing guns beneath a bed.

BACKGROUND ART

There is a recognized need for a means to mount a receptacle to the side of a bed so as to permit ready access to a gun. In recent years, there have been increasing numbers of incidents of burglars, rapists and other criminals breaking into homes at night and committing serious and violent crimes. Many have concluded that they must provide for their own personal safety and have acquired guns, handguns or shotguns, which they keep, variously, in dresser or night stand drawers, under mattresses, under pillows, etc. Each of these approaches is fraught with the obvious disadvantage that the protective handgun is not readily available when most needed. Additionally, each of these approaches is also presented with the conspicuous problem of access by unauthorized persons, such as children.

Various U.S. patents have issued in the past which address the need for access to guns in proximity to beds. Goodman U.S. Pat. No. 4,869,449, issued on Sep. 26, 1989 shows a lockable gun safety drawer having a gun drawer slidably engaged within a recessed drawer housing which is attached to the underside of a bed. A bed side bracket is configured so as to be received between the angle iron bed frame member and the bottom edge of the bed's box springs. The drawer housing has a top plate, side panels, back panels, and bottom panels. A holster post is attached to and extends upwardly from the bed side bracket and is adapted to hold a holstered gun in ready position at bed side.

C. Kontorowitz U.S. Pat. No. 1,423,804 issued on Jul. 25, 1922, E. C. Ulm U.S. Pat. No. 2,885,694 issued on May 12, 1959 and Fried et al. U.S. Pat. No. 2,854,676 issued on Oct. 7, 1958 disclose various drawers that are suitable for attachment to the underside of a bed. In particular, each of these patents describe various techniques for bracketing the drawer to the bed so as to allow for easy accessibility.

J. McGinley U.S. Pat. No. 4,971,390 issued on Nov. 20, 1990, discloses a safety locker drawer for use on the underside of a chair. This invention shows a slidable drawer which includes suitable brackets for attaching to the underside of the support bars of a chair. A locking arrangement is provided which securely locks the drawer within the support structure.

Each of these above-described patents provides a system which allows for ready accessibility to a gun in times of need. However, they are not particularly addressed to the safety of children within the home. Whenever it is necessary to place a gun in close proximity to a bed, suitable precautions must be taken so as to assure that children do not have access to the gun during the day or when unsupervised. The construction of the gun-containing drawers or cabinets should be such as to provide adequate safeguards for the prevention of access by children. Additionally, the design of such a drawer or cabinet should allow for ease of accessibility. The drawer or cabinet should also be suitable for allowing a means for the secure storing of other items.

It is an object of the present invention to provide a gun storage cabinet which can be easily attached to the underside of a bed frame.

It is another object of the present invention to provide a gun storage cabinet which allows for easy accessibility in times of danger.

It is another object of the present invention to provide a gun storage cabinet which prevents access by children.

It is still a further object of the present invention to provide a gun storage cabinet which is easy to manufacture, easy to install, and relatively inexpensive.

These and other objects and advantages of the present invention will become apparent from a reading of the attached specification and appended claims.

SUMMARY OF THE INVENTION

The present invention is a gun safe which is useful for attachment to a bed frame. The gun safe of the present invention includes a receptacle having a closed end and an open end. The receptacle has a size suitable for containing a gun therein. A door is connected to the open end of the receptacle so as to selectively expose an interior of the receptacle. The door is movable between an open position and a closed position. A lock is connected to the door so as to lockably engage the receptacle. A clamp is attached to the forward end of the receptacle so as to affix the receptacle to a bed frame. The door is in hinged relationship with a base of the receptacle at the open end. The receptacle has a fastening surface extending downwardly at the open end. A compression spring is affixed to the fastening surface so as to exert a force on the door for urging the door into the open position. A block of foamed material is positioned within the receptacle adjacent to the closed end. The block extends a desired distance from the closed end toward the open end. A leg is fastened to the rear of the receptacle adjacent to the closed end. This leg supports the receptacle in a level condition above a surface. The receptacle is a square tubular member having a size sufficient for receiving a gun therein.

In an alternative embodiment, the present invention is a receptacle for attachment to a bed frame comprising a cover, a drawer slidably received by the cover such that the drawer is slidable with respect to a fixed cover, a lock attached to the drawer so as to fix a position of the drawer beneath the cover, a clamp attached to a forward end of the cover for affixing the cover to a bed frame, and a support connected to the back end of the cover for supporting the cover a desired distance above a surface. The lock engages the cover when it is desired to lock the drawer.

The forward end of the cover has a formed lip extending upwardly thereacross. The formed lip engages a portion of the bed frame. The cover has at least one hole extending therethrough adjacent to this forward end. The clamp has a mounting bracket affixed by a bolt to the cover. The mounting bracket engages one surface of the bed frame. The cover abuts another surface of the bed frame such that the bed frame is secured between the mounting bracket and the cover. The bolt affixes the mounting bracket to the bed frame. The cover has a top surface and a bottom surface. The mounting bracket is juxtaposed against the top surface. The bolt is secured by a nut positioned adjacent to the bottom surface of the cover and within the area defined by the drawer. The formed lip of the cover engages a vertical surface of the bed frame. In general, the mounting bracket has a Z-shaped configuration.

The drawer has a base, a pair of sides extending upwardly from the base, and a pair of ends connected to the sides and extending upwardly relative to the base. One of the ends receives the lock therein. The base, the sides, and the ends form a receptacle for the storage of items, such as guns, therein. The drawer has a removable divider extending between the sides and above the base. The forward end of the drawer has the lock positioned therein. This forward end is in hinged relationship with the base of the drawer. The cover has a fastening surface extending downwardly therefrom. The lock is movable between a locked position and an unlocked position. The lock engages the fastening surface when in the locked position. The lock is free of the fastening surface in the unlocked position. The key to the lock can only be removed when the lock is in its locked position.

The support comprises an extensible leg fastened to a rear end of the cover. This leg extends upwardly from the surface (e.g., a floor) so as to maintain the cover in a generally level condition. The drawer and its cover are positioned beneath the bed frame so as to extend within the area of the bed frame. The drawer has a size suitable for receiving a gun therein.

DETAILED DESCRIPTION OF THE INVENTION

Figure 1:
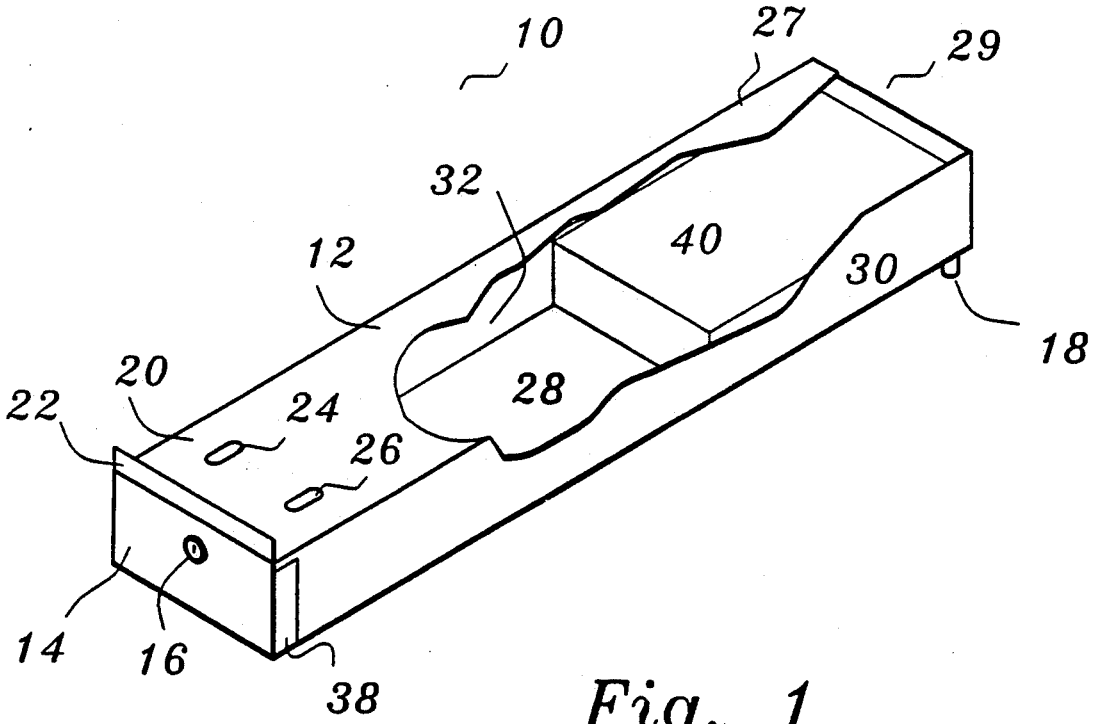
FIG. 1 is a perspective, partially cutaway, view of the gun safe in accordance with the preferred embodiment of the present invention.

Referring to FIG. 1, there is shown at 10 the gun storage cabinet in accordance with the preferred embodiment of the present invention. Gun storage cabinet 10 comprises a receptacle 12, a door 14, a lock 16, and a support 18. In FIG. 1, the interior of the receptacle 12 is shown by a cutaway view.

Initially, it can be seen that the receptacle 12 is an elongated generally square tubular member which extends for a length suitable for receiving a gun therein. The receptacle 12 has an open end 20 which has a formed upward extending lip 22. Lip 22 extends across the width of receptacle 12. The formed lip 22 is suitable for engaging a portion of a bed frame. The receptacle 12 also includes a first hole 24 and a second hole 26 extending through the thickness of the top side 27 and positioned generally adjacent to the open end 20. The receptacle 12 has a closed end 29 opposite to open end 27. The receptacle 12 is a single unit for the containment of a gun therein. In typical use, the top side 27 of receptacle 12 will be affixed to the frame of a bed. The door 14 will open relative to the open end 20 so as to expose the interior of the receptacle 12.

The receptacle 12 includes a base 28, and side walls 30 and 32. The base 28 is generally flat and extends for the length of the receptacle 12. The side walls 30 and 32 extend upwardly from the base. The closed end 29 extends between the sides 30 and 32 and extends upwardly from base 28. The base 28, the side walls 30 and 32, and the closed end 29 cooperate so as to define the gun-receiving space within receptacle 12.

It can be seen that the door 14 receives the lock 16. Door 14 has a pair of side flaps 38 which overlap the exterior of sides 30 and 32. It can also be seen in FIG. 1 that a block 40 of foam material (such as styrofoam) is positioned within receptacle 12 adjacent to closed end 29. The block 40 extends toward the open end 20. The block 40 can be formed and adjusted so as to properly accommodate the gun positioned within the interior of gun safe 10.

Lock 16 is a conventional lock that is fitted into the door 14. The lock 16 serves to retain the door 14 in position when the lock engages a fastening surface on the cover 12. Ideally, the lock 16 should be the type of lock in which a key cannot be removed unless the door 14 is in a locked position. Such a configuration greatly increases the safety factor of the present invention. By using such a lock, the door will always remain locked until access to the interior of the gun safe 10 is required.

Figure 2:
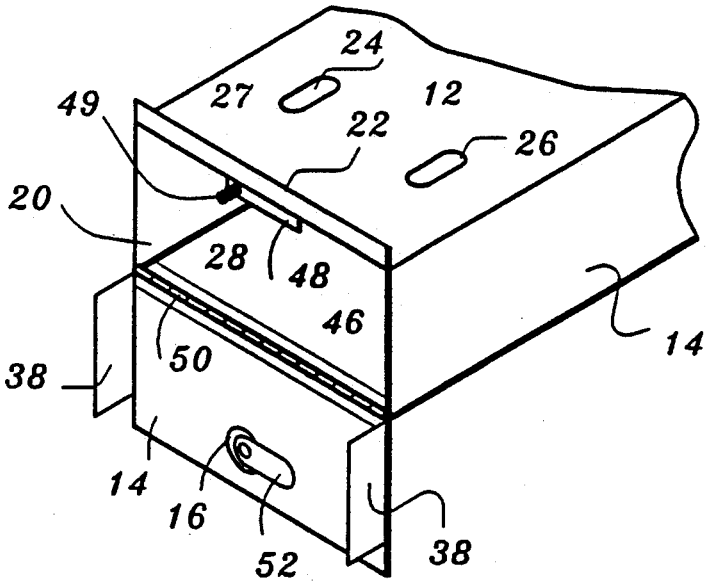
FIG. 2 is a perspective view of the open end of the gun safe of FIG. 1 showing the hinged relationship of the door with the receptacle.

Referring to FIG. 2, it can be seen how the interior of receptacle 12 is configured so as to allow access to a gun, or other item, within the interior 46. Initially, in FIG. 2, it can be seen that the top surface 27 has a pair of elongated slots 24 and 26 The formed upward extending lip 22 is positioned at the very end of top surface 27 adjacent to the end of receptacle 12. Importantly, a fastening surface 48 extends downwardly from the end of receptacle 12. Fastening surface 48 is a rigid surface which allows the lock 16 to engage the receptacle for the purpose of affixing the position of the door 14.

In FIG. 2, the door 14 is connected by piano hinge 50 to the base 28 of receptacle 12. The door 14 includes the overlapping side flaps 38 Side flaps 38 extend perpendicularly outwardly from the door 14. The lock 16 includes a cam 52 which has a suitable length and configuration so as to rigidly engage the fastening surface 48 of receptacle 12. When the lock 16 is released and in its unlocked position, there is easy access to the interior 46 of receptacle 12. A compression spring 49 is attached to fastening surface 48 and extends outwardly therefrom. The spring 49 is configured so as to urge door 14 into its open position when the cam 52 of lock 16 is out of engagement with fastening surface 48. This is a safety feature since it assures that door 14 is not inadvertently unlocked. In the locked position, the door 14 will assume a configuration similar to that shown in FIG. 1.

Figure 3:
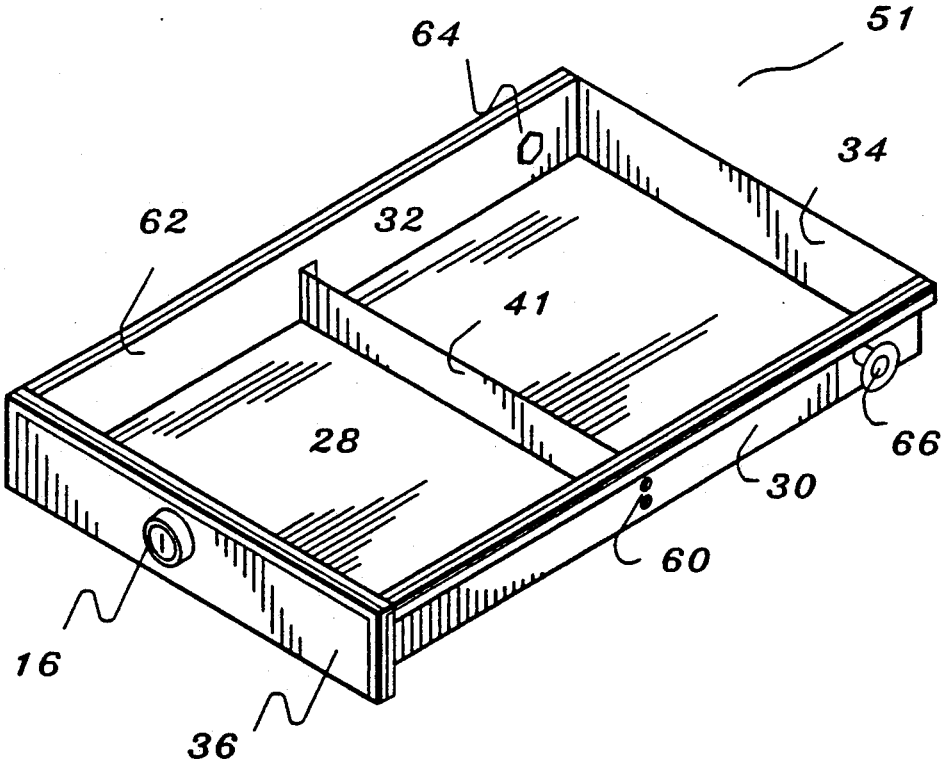
FIG. 3 is a perspective view showing the drawer of an alternative embodiment of the present invention.

FIG. 3 is an isolated view of drawer 51 in accordance with an alternative embodiment of the present invention. Initially, it can be seen that the drawer 51 includes a base surface 28, side walls 30 and 32, and end panels 34 and 36. Fasteners 60 can be used so as to permanently retain the divider 41 in its position between side walls 30 and 32. Divider 41 is used to divide the interior of drawer 51 into separate storage compartments. For example, a gun can be stored in compartment 62. Other valuables could be stored in compartment 64. The storage capabilities of the drawer 51 are virtually limitless.

It can further be seen in FIG. 3 that the lock 16 is provided on the end panel 36. In the configuration of the drawer 51 shown in FIG. 3, the end panel 36 is affixed in its position perpendicular to the base 28. In the embodiment of FIG. 3, the end panel 36 is not hinged to base 28. As such, the drawer 51, of FIG. 3, serves the purpose of sliding with respect to a cover (shown in FIG. 4). A spring retainer stud 66 is provided on the outer surfaces of side walls 30 and 32.

Figure 4:
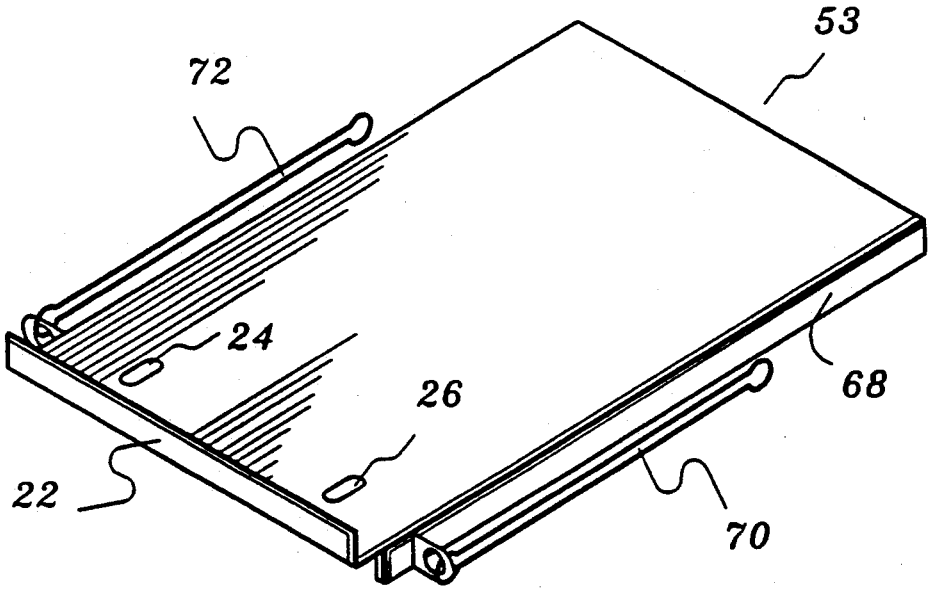
FIG. 4 is a perspective view of the cover of an alternative embodiment of the present invention.

FIG. 4 illustrates an isolated view of the cover 53. It can be seen that cover 53 has a generally rectangular configuration. At the forward end of the cover 53 is the upwardly extending perpendicular lip 22. The lip 22 extends across the width of the cover 53. A pair of openings 24 and 26 are provided so as to receive a mounting bracket for securing the cover 53 to a frame of a bed. Cover 53 includes downwardly extending side edge portions 68. The edge portions 68 serve to overlap the top edge of the sides 30 and 32 of drawer 51. Spring arms 70 and 72 extend parallel to the side edges of the cover 53. In conventional fashion, the spring retaining studs 66 of drawer 51 will engage with the ends of spring arms 70 and 72.

Figure 5:
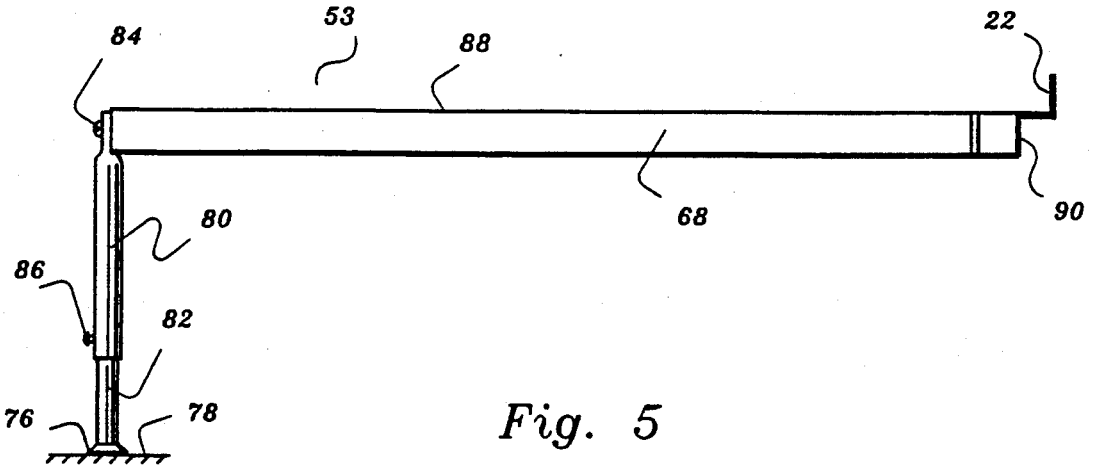
FIG. 5 is a side elevational view showing the support as attached to the cover of the alternative embodiment of the present invention.

Referring to FIG. 5, there is shown the cover 53 in an isolated view. Importantly, FIG. 5 shows the use of the support 18 as affixed to end 74 of cover 53. The support 18 includes an abutment surface 76 at an end opposite to the cover 53 which is suitable for resting on a surface 78. The support 18 is a leg which helps to support the cover 53 in a relatively level condition. The support 18 comprises a first leg portion 80 and a second leg portion 82. The second leg portion 82 is slidably received within the interior of the first leg portion 80. The abutment surface 76 is attached to the end of the second leg portion 82. The top of the first leg portion 80 is threadedly fastened at 84 to the end 74 of cover 53. The support 18 extends perpendicularly downwardly from the cover 53. An adjustment mechanism 86 is provided so as to control the length of the support 18. Essentially, the adjustment mechanism 86 is a threaded member which can be manipulated so as to adjust the movement of the second leg portion 82 with respect to the first leg portion 80.

Additionally, in FIG. 5, it can be seen that the edge portions 68 extend downwardly from the top surface 88 of cover 53. The formed lip 22 extends upwardly and outwardly from the end 90 of cover 53.

Figure 8:
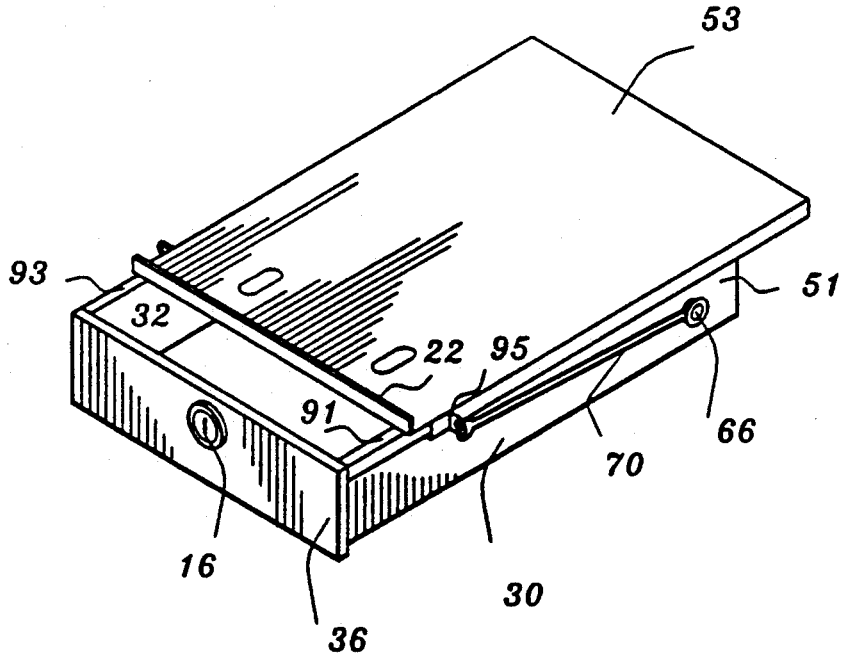
FIG. 8 is a perspective view of the alternative embodiment of the present invention.

FIG. 8 shows the manner in which the cover 53 is fastened to the drawer 51. In particular, the cover 53 slides along rail 91 and 93 on the side walls 30 and 32 of drawer 51. As the cover 53 slides with respect to the drawer 51, the interior of the gun safe is exposed. The end wall 36 moves outwardly from the upturned lip 22 so as to expose the interior.

During normal operation it is desirable to have the drawer 51 open automatically with respect to the cover 53 whenever the lock 16 is disengaged. As such, the spring retaining stud 66 engages the end of spring arm 70. Spring arm 70 has its other end connected to a fastener 95. Spring arm 70 may be a resilient member which serves to urge the stud 66 toward the fastener 95. When the cover 53 is fastened to the underside of a bed frame, the cover 53 will be stationary. When the lock 16 is unlocked, the forces exerted by spring arm 70 (and spring arm 72 on the opposite side of drawer 51) will cause the drawer 51 to move outwardly, in the fashion shown in FIG. 8, so as to expose the interior. The present invention, thusly, provides easy access to the interior of the gun safe. This spring-type mechanism is also an additional safety feature since the gun safe will not remain closed unless the lock 16 is in its locked position securing the end wall 36 adjacent to the upturned lip 22 of cover 53.

Figure 6:
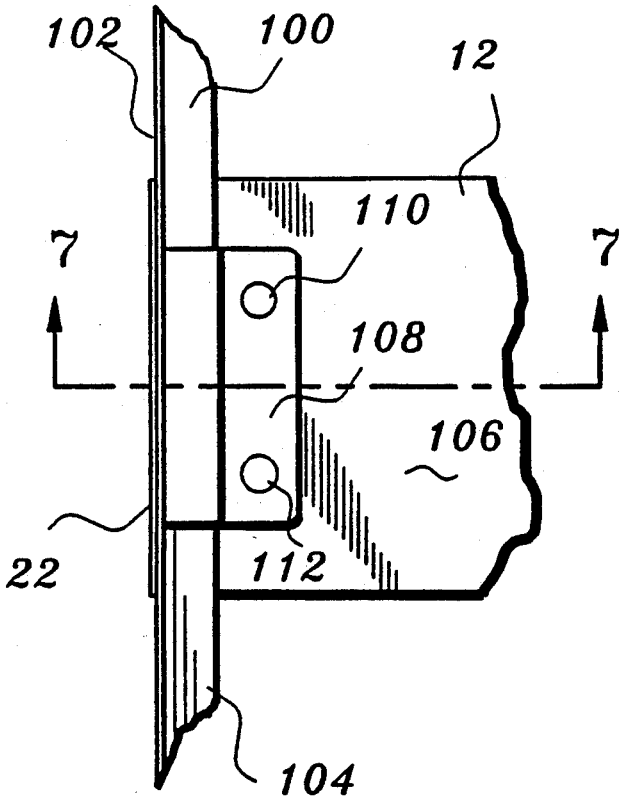
FIG. 6 is a partial plan view of the clamping mechanism of the present invention.
Figure 7:
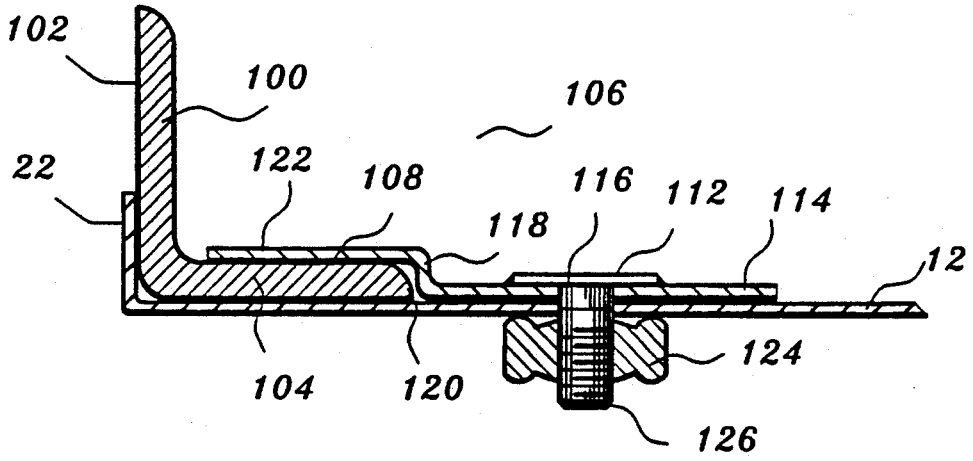
FIG. 7 is a cross-sectional view taken across line 7—7 of FIG. 6 showing the clamping mechanism of the present invention.

It should be noted that an important aspect of the present invention is the ability of the present invention to be properly attached to a bed frame. FIGS. 6 and 7 illustrate the mechanism by which the gun safe 10 of the present invention can be affixed to the bed frame so as to support the cabinet 10, cover 53, and the drawer 51 in their proper positions.

In FIG. 6, it can be seen from the plan view of FIG. 6 that the bed frame 100 is a longitudinal angle iron which, in common use, forms the perimeter of the base of the bed. Typically, the bed frame 100 is made of iron or steel. The receptacle 12 (or cover 53) is affixed to the bed frame 100 by initially placing the upwardly extending lip 22 in abutment with the vertical surface 102 of bed frame 100. The vertical surface 102 essentially acts as a stop to the movement of the receptacle 12 (or cover 53) with respect to the bed frame 100. The receptacle 12 extends below the horizontal portion 104 of the bed frame 100.

In order to secure the receptacle 12 to the bed frame 100, a clamping mechanism 106 is provided so as to adequately secure the receptacle 12 in its position relative to the bed frame 100. Clamping mechanism 106 comprises a mounting bracket 108 which extends over the horizontal portion 104 of bed frame 100. A pair of bolts 110 and 112 are provided so as to secure the mounting bracket 108 to the receptacle 12. The mounting bracket 108, in combination with the top surface of receptacle 12 sandwiches the horizontal portion 104 of the bed frame 100. The clamping mechanism 106, in combination with the upward extending lip 22 secures the receptacle 12 from upward, downward, and lateral motion movement with respect to the bed frame 100.

FIG. 7 specifically illustrates the arrangement in which the clamping mechanism 106 is used so as to secure the receptacle 12 to the bed frame 100. In FIG. 7, it can be seen that the bed frame 100 is an angle iron of conventional L-shape. The upwardly extending lip 22 is in abutment with a vertical surface 102 of the bed frame 100. The top surface 112 of receptacle 12 is in surface-to-surface contact with the horizontal portion 104 of the bed frame 100. It can be seen that the receptacle 12 extends horizontally from the bed frame 100.

The clamping mechanism 106 includes the mounting bracket 108. Mounting bracket 108 is a Z-shaped member which includes a first surface 114 which is in surface-to-surface contact with the top surface 112 of the receptacle 12 (or cover 53). An aperture 116 is formed in the portion 114 of mounting bracket 108 so as to allow bolt 112 to pass therethrough and through the aperture 26 of receptacle 12.

The mounting bracket 108 includes an upturned portion 118 which is placed in proximity to an end 120 of the bed frame 100. Another horizontal portion 122 of mounting bracket 108 is in surface-to-surface contact with the top surface of the horizontal portion 104 of bed frame 100. As the bolt 116 secures the mounting bracket 108 to the receptacle 12, the portion 122, in combination with receptacle 12, serves to sandwich the horizontal portion 104 of bed frame 100 therebetween.

It can be seen that the bolt 112 extends downwardly through the top surface of receptacle 12 and into an area which is defined by the walls of the receptacle 12 (or the drawer 51). A nut 124 extends around the threaded portion 126 of bolt 112 so as to secure the bolt 112 in its proper position. It is important to note that when the drawer is in its locked position, it is impossible to gain access to the nut 124 for the purpose of removing the cabinet 10 from its position as joined to the bed frame. As such, the present invention provides additional security against theft or intrusion.

The cabinet and drawer of the present invention is suitable for receiving guns. Depending on the size of the drawer and cover, the present invention is adaptable for receiving handguns, shotguns, or rifles. The divider can be used for the purpose of preventing short guns from sliding out of reach. The divider can also be used for the storage of other items, such as ammunition or other weaponry. The cabinet of the present invention is designed to be fastened to a steel bed frame. The special bracket can only be removed when the units are unlocked. The locks that are used are the type that allow key removal only in a locked position. A detachable adjustable rear leg is furnished with each unit so as to prevent sagging of the unit.

The present invention allows the gun owner to have his gun in a convenient location at night in case of break in, intrusion, or other instances of danger. Additionally, the type of lock which is used in the present invention prevents the unit from being left unlocked by placing the key on a keyring used daily. This will keep the gun protected from children during the day or when the children are unsupervised. The present invention is particularly adapted for child safety.

The foregoing disclosure and description of the invention is illustrative and explanatory thereof. Various changes in the details of the illustrated construction may be made within the scope of the present claims without departing from the true spirit of the invention. The present invention should only be limited by the following claims and their legal equivalents.

I claim:

1. A gun safe for attachment to a bed frame comprising:

a receptacle having a closed end and an open end, said receptacle having a size suitable for containing a gun therein, said receptacle having at least one hole extending therethrough adjacent said open end;

a door means connected to said open end of said receptacle, said door means for selectively exposing an interior of said receptacle, said door means movable between an open position and a closed position;

a locking means connected to said door means so as to lockably engage said receptacle; and a clamp attached to a forward end of said receptacle for affixing said receptacle to the bed frame, said clamp having a mounting bracket affixed by a bolt to said receptacle, said mounting bracket for engaging one surface of the bed frame, said receptacle for abutting another surface of the bed frame, said bolt for affixing said mounting bracket to the bed frame, said receptacle having a top side with a top surface and a bottom surface, said mounting bracket juxtaposed against said top surface, said bolt secured by a nut, said nut positioned adjacent said bottom surface within an area defined by an interior of said receptacle, said receptacle having a formed lip extending upwardly at the open end of said receptacle, said formed lip for abutment with a vertical surface of the bed frame, said mounting bracket and said top surface of said receptacle in abutment with a horizontal surface of said bed frame.

2. The gun safe of claim 1, said receptacle having a drawer slidably connected to a cover, said cover for affixing to the bed frame, said drawer having a base, a pair of sides extending upwardly from said base, and a pair of ends connected to said sides and extending upwardly relative to said base.

3. The gun safe of claim 2, one of said ends receiving said locking means, said base, said sides, and said ends defining a area for the storage of items therein.

4. The gun safe of claim 3, said drawer having a removable divider extending between said sides above said base.

5. The gun safe of claim 1, said receptacle having said door means in hinged relationship with a base of said receptacle at said open end, said receptacle having a fastening surface extending downwardly at said open end.

6. The gun safe of claim 5, said locking means movable between a locked position and an unlocked position, said locking means engaging said fastening surface when in said locked position, said locking means free of said fastening surface in said unlocked position.

7. The gun safe of claim 6, said locking means having a compression spring affixed to said fastening surface so as to exert a force on said door means for urging said door means toward said open position.

8. The gun safe of claim 1, said receptacle having a block of foamed material positioned therein and adjacent said closed end, said block extending a desired distance from said closed end toward said open end.

9. The gun of claim 1, further comprising:

a leg fastened to a rear of said receptacle adjacent said closed end, said leg for supporting said receptacle in a level condition above a surface.

10. The gun safe of claim 1, said receptacle being a square tubular member.

11. A gun safe for attachment to a bed frame comprising:

a receptacle having a closed end and an open end, said receptacle having a size suitable for containing a gun therein, said receptacle having at least one hole extending therethrough adjacent said open end;

a door means connected to said open end of said receptacle, said door means for selectively exposing an interior of said receptacle, said door means movable between an open position and a closed position;

a locking means connected to said door means so as to lockably engage said receptacle; and a clamp attached to a forward end of said receptacle for affixing said receptacle to the bed frame, said clamp having a mounting bracket affixed by a bolt to said receptacle, said mounting bracket for engaging one surface of the bed frame, said receptacle for abutting another surface of the bed frame, said bolt for affixing said mounting bracket to the bed frame, said receptacle having a top side with a top surface and a bottom surface, said mounting bracket juxtaposed against said top surface, said bolt secured by a nut, said nut positioned adjacent said bottom surface within an area defined by an interior of said receptacle, said mounting bracket having a generally Z-shaped configuration, a first surface of said Z-shaped configuration is in surface-to-surface contact with said top surface of said receptacle, said first surface having an aperture therein aligned with said hole of said receptacle for receiving said bolt, said Z-shaped configuration having a second surface in abutment with a surface of the bed frame.

* * * * *